US006778633B1

(12) United States Patent
Loxley et al.

(10) Patent No.: US 6,778,633 B1
(45) Date of Patent: Aug. 17, 2004

(54) METHOD AND APPARATUS FOR PROLONGING THE LIFE OF AN X-RAY TARGET

(75) Inventors: Neil Loxley, Durham (GB); Mark Taylor, Darlington (GB); John Leonard Wall, Newton Aycliffe (GB); Graham Vincent Fraser, Darlington (GB)

(73) Assignee: BEDE Scientific Instruments Limited, Durham (GB)

( * ) Notice: Subject to any disclaimer, the term of this patent is extended or adjusted under 35 U.S.C. 154(b) by 0 days.

(21) Appl. No.: 09/937,609

(22) PCT Filed: Mar. 27, 2000

(86) PCT No.: PCT/GB00/01164

§ 371 (c)(1),
(2), (4) Date: Jan. 28, 2002

(87) PCT Pub. No.: WO00/58991

PCT Pub. Date: Oct. 5, 2000

(51) Int. Cl.[7] ..... H05G 1/52
(52) U.S. Cl. ..... 378/113; 378/138; 378/160
(58) Field of Search ..... 378/113, 160, 378/138

(56) References Cited

U.S. PATENT DOCUMENTS

| | | | | |
|---|---|---|---|---|
| 4,631,742 A | | 12/1986 | Oliver | |
| 4,689,809 A | | 8/1987 | Sohval | |
| 4,748,650 A | | 5/1988 | Ammann | |
| 5,812,632 A | * | 9/1998 | Schardt et al. | 378/137 |
| 5,822,395 A | * | 10/1998 | Schardt et al. | 378/137 |
| 5,857,008 A | | 1/1999 | Reinhold | |
| 6,181,771 B1 | * | 1/2001 | Hell et al. | 378/137 |
| 6,339,635 B1 | * | 1/2002 | Schardt et al. | 378/137 |
| 6,438,207 B1 | * | 8/2002 | Chidester et al. | 378/138 |

FOREIGN PATENT DOCUMENTS

| | | |
|---|---|---|
| EP | 0 473 852 | 3/1992 |
| JP | 10-340695 | 12/1998 |
| WO | WO 98/13853 | 4/1998 |

* cited by examiner

*Primary Examiner*—Craig E. Church
(74) *Attorney, Agent, or Firm*—Blackwell Sanders Paper Martin LLP

(57) ABSTRACT

An X-ray generator comprises an evacuated and sealed X-ray tube, containing an electron gun and an X-ray target. An electron beam is produced by the electron gun in which the cathode is at negative high voltage, the electron gun consisting of a filament just inside the aperture of a Wehnelt grid which is biased negatively with respect to the filament. Two sets of beam deflection coils, are employed in two planes, mounted between the anode of the electron gun and the focussing lens to center the beam. Between the focussing lens and the target is an air-cored quadripole magnet which acts as a stigmator in that it turns the circular cross-section of the beam into an elongated one. This quadripole can be rotated about the tube axis so as to adjust the orientation of the line focus. The beam can be moved about on the target surface by controlling the currents in the four coils of the quadripole.

12 Claims, 3 Drawing Sheets

METHOD AND APPARATUS FOR PROLONGING THE LIFE OF AN X-RAY TARGET

APPLICATION CROSS-REFERENCES

This application is a U.S. national phase application of International Patent Application No. PCT/GB00/01164 and published in English, filed Mar. 27, 2000, which claims priority of Great Britain Patent No. 9906886.8, filed Mar. 26, 1999.

BACKGROUND OF THE INVENTION

This invention relates to an X-ray generator, and in particular to apparatus for prolonging the life of an X-ray target used within an X-ray generator.

Known X-ray generators comprise an electron gun, an X-ray target and an X-ray exit window. These generators produce X-rays by accelerating electrons from the electron gun into the x-ray target. X-rays are emitted from the target through the exit window. Such generators may be in the form of sealed X-ray tubes, for example microfocus tubes, which are evacuated once and then sealed off, or in the form of rotating anode generators, which are permanently connected to vacuum pumps and are continuously evacuated during operation.

A major limitation to the longevity of X-ray generators is the lifetime of the target. All targets degrade over time due to the effects of heat and roughening caused by the electron bombardment. There are various known methods for reducing these effects, including cooling the back of the target with flowing water or rotating the target so that no one area of the target is continuously subjected to the electron bombardment. Methods of increasing the cooling efficiency have been proposed based on using high conductivity materials such as diamonds. However, these methods are not in common usage currently.

With known X-ray generators, it can take a number of minutes after switching on the machine before it has stabilized and is ready for use. As a result, many generators are simply left running throughout the day, so that the "warm-up" or stabilization delay is removed. This means that the electrons are focussed on the target for long periods of time during each use of the generator, which leads to accelerated degradation of the target, even though the radiation produced by the X-ray generator is used only for short periods.

In cases where the construction of the generator permits, the target can be replaced. Where the construction does not permit target replacement in a routine procedure, then it is common practice to discard the complete tube assembly making up the X-ray generator.

In commercially available sealed tube and rotating anode generators, there is no provision to control the position of the beam on the target or to control the quality, size or shape of the focal spot on the X-ray target. The quality of the X-ray beam emitted can deteriorate rapidly with prolonged use due to contamination and damage to the target area under continuous electron bombardment.

In the case of rotating anode generators, once performance has degraded below a useful level, replacement of the target is required. This entails cost of replacement parts as well as significant down time of the generator. In the case of sealed tube generators it is necessary to discard the whole tube and replace it with a new tube.

BRIEF SUMMARY OF THE INVENTION

It is an object of the present invention to provide means to lengthen the life of a target, and thereby to lengthen the life of the X-ray generator. By controlling the position and brightness of the beam, the apparatus according to the present invention can reposition and modify the area of focus of the beam. Defocussing the beam reduces the flux per unit area of electrons on the target. Repositioning the beam enables a fresh area of the target to be exposed to electrons. The lifespan of the target is prolonged by either of these means, and the time interval between replacements of the target or of the complete tube assembly is increased.

A consequence of the approach of the present invention is that the tube is only required to run in operational condition with the target exposed to focussed electrons when the operator requires the X-ray beam to be produced.

According to the present invention, there is provided an X-ray generator comprising an electron gun, electron focussing means, a target and electronic control means, wherein the area of the target on which the focussing means causes electrons from said electron gun to impinge comprises an X-ray source, the control means being adapted to control the electron focussing means so that the X-ray source on said target may be varied in size and/or shape and/or position.

According to a first aspect of the invention the control means includes a switching means to switch the electron focussing means between a first unfocussed state in which the X-ray source has a first area and a second focussed state in which the X-ray source has a second area smaller than said first area. The second area may be a line, a spot or some other profile. The first area may be a line of greater thickness, a spot of greater diameter or some other shape.

Preferably said first area has a surface area at least twice, more preferably four times, most preferably ten times that of said second area.

According to a second aspect of the invention the control means includes a switching means to switch the electron focussing means between a plurality of focussed states, whereby in each state the X-ray source is in a corresponding discrete position on said target. The X-ray source may be in the form of a line, a spot or some other profile on the target.

The electron gun may comprise an evacuated tube around which the electron focussing means is mounted outside the vacuum. Alternatively the electron gun may comprise an evacuated tube within which the electron focussing means is mounted. The evacuated tube may be a sealed vacuum tube or may be connected to a vacuum pump which permits continuous evacuation during operation of the generator.

The electron focussing means may comprise an x-y deflection system for centering the electron beam in the tube. The electron beam focussing means may further comprise at least one electron lens, preferably an axially symmetric or round lens, and/or at least one quadripole or multipole lens for focussing the electron beam to a line focus and for steering the electron beam.

The electron beam lenses may be magnetic or electrostatic.

Preferably the target is metal, most preferably a metal selected from the group Cu, Ag, Mo, Rh, Al, Ti, Cr, Co, Fe, W, Au. The target surface may be orientated such that the plane of the target surface is perpendicular or at an angle to the axis of the X-ray tube.

According to a third aspect of the present invention there is also provided a method for extending the life of a target of an X-ray generator, wherein the generator comprises an electron gun, electron focussing means and a target, the method comprising the steps of:

firing electrons at the target such that the area of the target on which the focussing means causes electrons from said electron gun to impinge comprises an X-ray source, controlling the electron focussing means to move between a first unfocussed state in which the X-ray source has a first area and a second focussed state in which the X-ray source has a second area smaller than said first area, the intensity of electron impingement in the first state being sufficiently low to reduce target degradation, the intensity of electron impingement in the second state being sufficiently high such that the source produces a predetermined required level of brightness and source size on the target. The source may be a spot, a line or some other profile.

Preferably the electron beam current is substantially the same in the first and second states, while the intensity of the beam per unit area at the target is lower in the first state than in the second state.

According to a fourth aspect of the present invention there is provided a method for extending the life of a target of an X-ray generator, wherein the generator comprises an electron gun, electron focussing means and a target, the method comprising the steps of:

firing electrons at the target such that the area of the target on which the focussing means causes electrons from said electron gun to impinge comprises an X-ray source, controlling the electron focussing means to move between a plurality of focussed states, whereby in each state the X-ray source is in a corresponding discrete position on said target, such that the intensity per unit area in each discrete position is substantially constant, and such that there is no overlap on the target between the discrete positions corresponding to each focussed state. The source may be a spot, a line or some other profile.

The lack of overlap between the discrete positions on the target means that a fresh area of target is used as a source each time the electron focussing means moves to a new state. The control of the electron focussing means may be manual but is preferably electronic, so that each discrete position corresponds to a pre-programmed control signal applied to the electron focussing means.

BRIEF DESCRIPTION OF THE DRAWINGS

An embodiment of the invention will now be described, by way of example only, with reference to the accompanying figures, where.

DETAILED DESCRIPTION OF THE INVENTION

Figure 1:
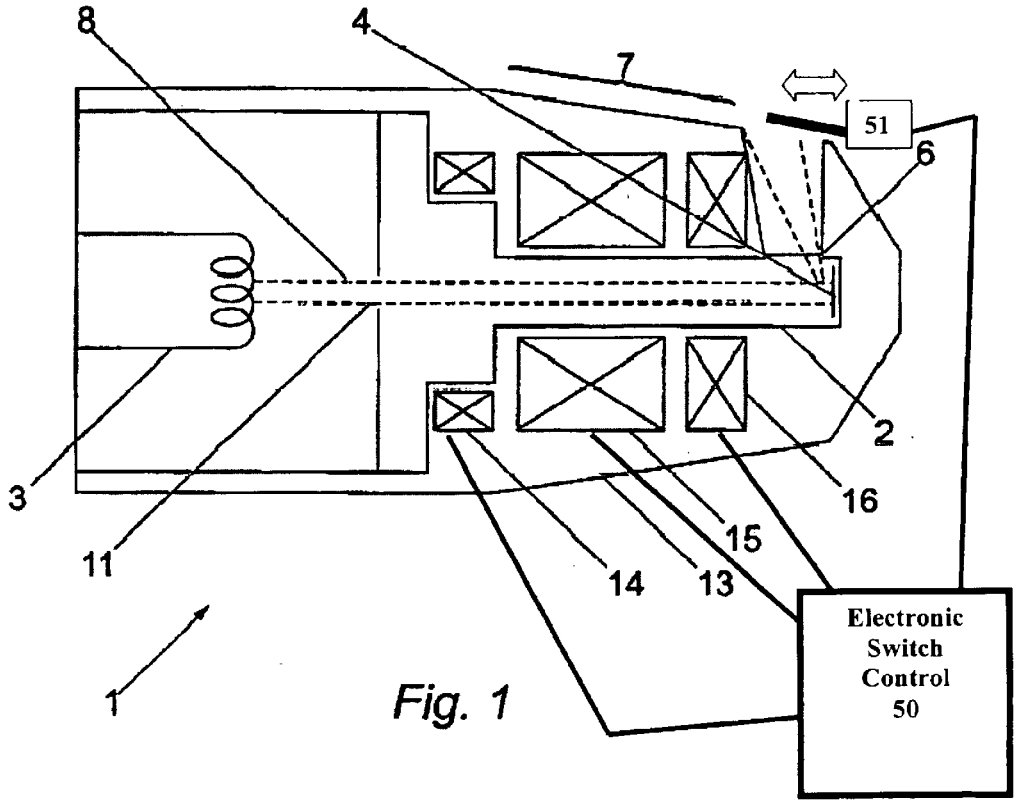
FIG. 1 shows a schematic longitudinal section through an X-ray generator according to the invention suitable for use with a close coupled X-ray focussing system (not shown)

With reference to FIG. 1, the X-ray generator 1 comprises an evacuated and sealed X-ray tube 2, containing an electron gun 3 and an X-ray target 4. The tube 2 has an exit window 6 through which X-rays are emitted from the target. Although the embodiment illustrated in FIG. 1 has a window 6 in front of the target 4, it is to be understood that the invention is applicable to other embodiments, for example X-ray generators in which the X-rays are emitted behind the target 4. The exit window does not form part of the invention and is not further described.

The tube 2 is contained within a housing 13. The generator 1 also includes a system 7 for focussing and steering the electron beam 8 onto the target 4.

The focussing and steering system is capable of producing a well focussed beam of electrons 8 impinging on the target 4. The electron beam 8 may be focussed into a spot or a line, and the dimensions of the spot and line as well as its position may be changed electronically. In typical X-ray applications a spot focus having a diameter falling in the range 1 to 100 λm, generally 5 λm or larger, may be required. Alternatively a line focus may be achieved whose width falls in the range 0.4 mm to 1.0 mm, and length in the range 5 mm to 15 mm.

The electron beam 8 is produced by an electron gun 3 consisting of a Wehnelt electrode and cathode. The cathode may be a filament of tungsten or alloy, for example tungsten-rhenium, having either a hairpin or a staple shape. Alternatively the cathode may be an indirectly heated activated dispenser cathode, which may be flat or of other geometry, for example a rod with a domed end. The dispenser cathode has the advantage of extended lifetime and increased mechanical strength. With a flat surface the dispenser cathode has the further advantage of requiring only an approximate degree of alignment in the Wehnelt electrode.

Primary focus is achieved by an anode at a suitable distance from the electron gun.

The electron beam 8 from the gun is centered in the X-ray tube 2 by a centering coil 14 or set of quadripole lenses. Alternatively it may be centered by multipole lenses. Alternatively mechanical means may be used to center the electron beam 8. The centering lens or coil 14 may be omitted, where the electron gun 3 is such that it produced an electron beam 8 which is sufficiently aligned within the tube 2.

The electron beam 8 is then focussed to a spot of varying diameter. Focussing down to a diameter of less than 5 λm or better may be achieved by an axial focussing lens 15 of the quadripole, multipole or solenoid type.

The spot focus may be changed to a line focus with a stigmator lens 16, which may comprise a further set of quadripole or multipole lenses. Lines with an aspect ratio of greater than 10:1 are possible. A line focus spreads the load on the target.

When viewed at a suitable angle, the line appears as a spot.

The lenses 15, 16 are preferably magnetic, but may be electrostatic. All the lenses are electronically controlled, enabling remote control and continuous alignment and scanning of the focal spot. Change from spot to line focus and change of beam diameter are also controlled remotely by varying the control signals to the electron focussing devices 7.

The electronic control of the lenses enables the electron beam 8 to be defocussed and/or repositioned on the target 4. As a result, the high intensity focal spot of the electron beam 8 is not continuously being directed at one particular area of the target 4, which means that the rate of degradation of the target will be significantly slower than with known X-ray generators. The electron beam 8 is only focussed at high intensity when the X-ray beam is required.

The actions of defocussing and refocussing the electron beam 8 are activated either at will by the operator by varying the power of the focussing coils, preferably by an electronic switch control 50, or automatically by the action of a shutter 51 on the output side of the X-ray beam or other external event defined by the operator.

The target 4 is a metal, for example Cu, but it can be another material depending on the wavelength of the characteristic radiation required, for example Ag, Mo, Al, Ti, Rh, Cr, Co, Fe, W or Au. The target 4 is either perpendicular to the impinging electron beam 8, or may be inclined to decrease the absorption of the emitted X-rays.

In an example of a preferred embodiment of the present invention, the cathode is at negative high voltage and the electron gun 3 consists of a filament just inside the aperture 11 of a Wehnelt grid which is biased negatively with respect to the filament. The electrons are accelerated towards the anode which is at ground potential and pass through a hole in the latter and then through the tube 2 towards the target 4. Two sets of beam deflection coils 14, which may be iron-cored, are employed in two planes separated by 30 mm, mounted between the anode of the electron gun 3 and the focussing lens 15 to center the beam. Between the focussing lens 15 and the target 4 is an air-cored quadripole magnet which acts as a stigmator 16 in that it turns the circular cross-section of the beam 8 into an elongated one. This quadripole 16 can be rotated about the tube axis so as to adjust the orientation of the line focus. The beam 8 can be moved about on the target surface 4 by controlling the currents in the four coils of the quadripole 16.

Figure 2:
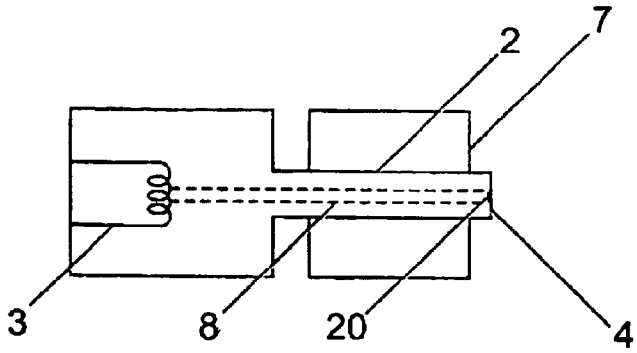
FIG. 2 shows a schematic arrangement of an X-ray generator in the focussed state.
Figure 3:
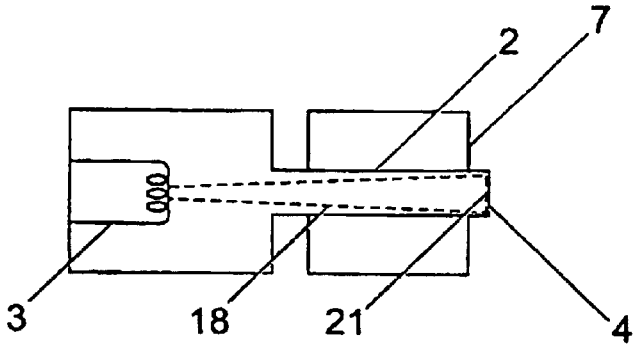
FIG. 3 shows a schematic arrangement of an X-ray generator in the defocussed state.

With reference to FIGS. 2 and 3 there is shown a tube 2, electron gun 3 and target 4, together with electron focussing means 7, which are discussed in more detail above. In the first focussed state, as shown in FIG. 2, the electron beam 8 is focussed by the focussing means 7 so that it forms a relatively small spot 20 on the target 4, the spot source being the required size for generation of X-rays for the intended purpose. In this state the X-ray generator is operational and the brightness of the emitted X-ray beam may be controlled by varying the applied power to the tube. When the generator is switched to the second unfocussed state as shown in FIG. 3, the electron beam 18 has the same power, but the focussing means does not focus the beam 18 so tightly, so that it forms a relatively larger spot source 21 on the target 4. In this state the X-ray generator is in standby mode and the intensity per unit area at the target 4 is greatly reduced. The consequent localized degradation of the target, which depends on local intensity per unit area, is also reduced.

Figure 4:
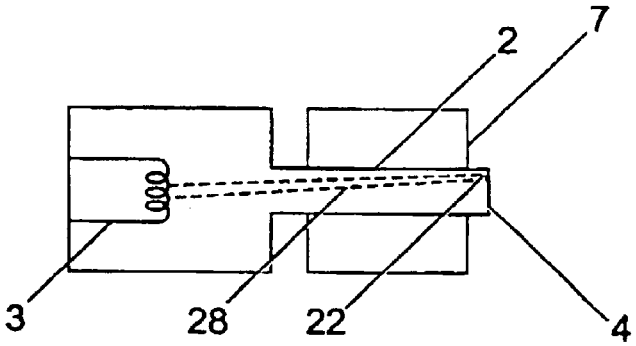
FIG. 4 shows a schematic arrangement of an X-ray generator with the target in a first focussed position.
Figure 5:
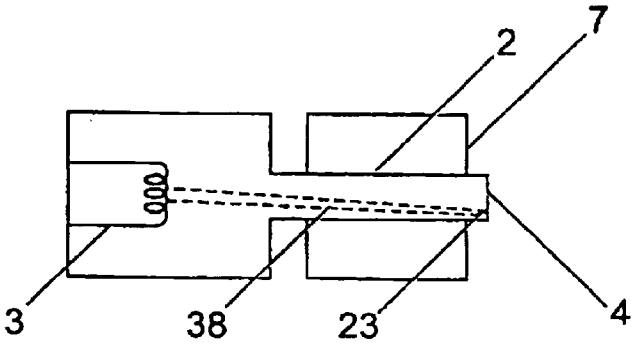
FIG. 5 shows a schematic arrangement of an X-ray generator with the target in a second focussed position.

With reference to FIGS. 4 and 5 there is shown a tube 2, electron gun 3 and target 4, together with-electron focussing means 7, which are discussed in more detail above. In the first focussed state, as shown in FIG. 4, the electron beam 28 is focussed by the focussing means 7 so that it forms a relatively small spot source 22 on the target 4, the spot source being the required size for generation of X-rays for the intended purpose. In this state, the X-ray generator is operational and the brightness of the emitted X-ray beam may be controlled by varying the applied power to the tube. When the generator is switched to a second focussed state, as shown in FIG. 5, the electron beam 38 has the same power, but is focussed by the focussing means to a second spot source 23 on a different part of the target 4. The spot source 23 is the required size for generation of X-rays for the intended purpose, and will generally be the same size as the spot source 22 in the first state. There is no overlap between the positions of spot sources 22 and 23.

In practice there may be further operational states in which the spot source is the same size as spot sources 22, 23 but in different, non-overlapping locations. It may be possible to fit as many as ten or more non-overlapping sources on a target, thus giving a ten-fold increase in the life of the target. The focussing means 7 may be adjusted manually to move the spot source, or the control signals required to adjust the focussing means may be stored electronically, so that the apparatus automatically steps to the next state when an operator indicates that the position of the focus should be changed. The stepping could be automatic after a predetermined elapsed operating time at a particular state, for example an elapsed time counter could be built into the apparatus to show a warning signal when the predetermined operating time is exceeded. The operator would then be alerted to switch the apparatus to the next state.

Although the examples of FIGS. 2 to 5 have been described with reference to spot sources, it is to be understood that the invention is equally applicable to line focus sources. Furthermore the illustrated embodiments have been described with a focussing means which comprises a centering lens, a focussing lens and a stigmator lens. It is to be understood that the functions of any of the three lenses may be combined in one or more lenses, and that the order of the components of the focussing means may be varied.

Figure 6A:
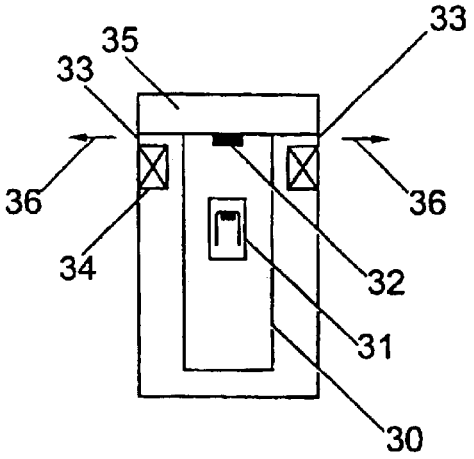
FIGS. 6(*a*) and 6(*b*) shows schematically a side view and plan view respectively on a sealed tube X-ray generator according to the invention.
Figure 6B:
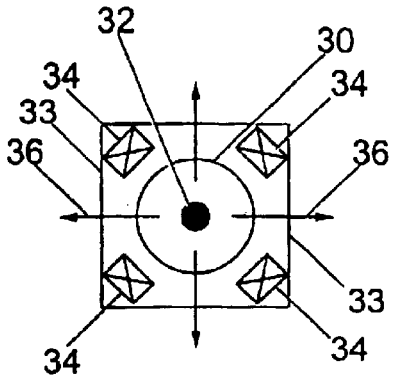

FIGS. 6(*a*) and 6(*b*) shows schematically a side view and plan view respectively on a conventional sealed tube X-ray generator. The generator comprises a sealed vacuum enclosure 30 fabricated from glass and metal, or from ceramic and metal. Inside the enclosure 30 is an electron gun 31 and a target 32. Adjacent to the target are X-ray transparent windows 33, through which X-rays 36 are transmitted. Surrounding the vacuum enclosure between the electron gun 31 and target 32 is an electrostatic or electromagnetic lens. Behind the target is a conventional water cooling arrangement 35.

The lens comprises one or more sets of focussing coils 34 arranged outside the vacuum envelope of the X-ray tube 30. The coils 34 forming the lens may be electromagnetic or electrostatic. At least one of the sets of focussing coils 34 is used to steer the electron beam from the electron gun 31 onto the target 32, and may also be used to change the shape and/or size of the beam. A switch control (not shown) may be provided which upon operation automatically provides the electrical power to the coils 34 so as to steer the electron beam to a larger focus or to a different point on the target. This enables the power density loading on the target 32 to be reduced when the X-rays are not being used, or for new areas of the target 32 to be periodically exposed when the previously exposed area becomes damaged or degraded. In FIG. 6 the coils 34 are shown as being external to the vacuum. In this way it is possible for the focussing coils 34 to be retrofitted to an existing generator, in order to prolong the life of the generator. However the scope of the invention includes the case where the coils 34 are built in to the generator and provided inside the vacuum enclosure 30.

Figure 7A:
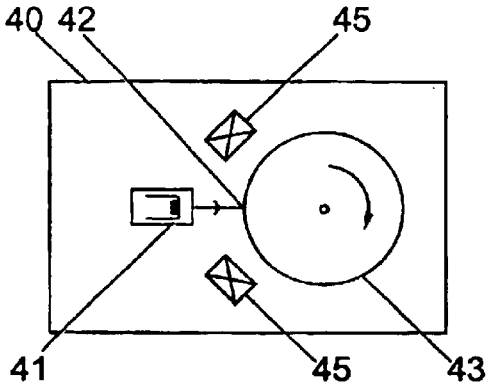
FIGS. 7(*a*) and 7(*b*) shows schematically a side view and front view respectively on a rotating anode X-ray generator according to the invention.
Figure 7B:
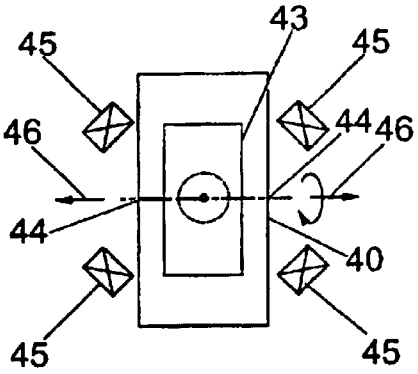

FIGS. 7(*a*) and 7(*b*) shows schematically a side view and front view respectively on a conventional rotating anode X-ray generator. The generator comprises a continuously pumped vacuum chamber 40 containing an electron gun 41 and a target 42 deposited on a cylindrical anode 43 which rotates at high speed. Adjacent to the anode are X-ray transparent windows 44, through which X-rays 46 are transmitted. Surrounding the vacuum chamber between the electron gun 41 and target 42 is an electrostatic or electromagnetic lens. The anode 43 is water cooled (not shown). The rotation of the anode 43 dissipates more effectively the heat generated on the target 42, so that increased power loading of the target and hence increased X-ray brightness are possible.

The electrostatic or electromagnetic lens comprises one or more sets of focussing coils 45 arranged outside the vacuum chamber 40. The coils 45 serve the same purpose as the coils 34 described with reference to FIG. 6 above, and may also be retrofitted or fitted within the vacuum chamber, i.e., the coils may be internal or external.

These and other modifications and improvements can be incorporated without departing from the scope of the invention.

What is claimed is:

1. An x-ray generator comprising an electron gun, electron focussing means, a target and electronic control means, wherein an area of the target on which the focussing means causes electrons from said electron gun to impinge comprises an x-ray source emitting an x-ray beam, the control means being adapted to control the electron focussing means so that the x-ray source on said target may be varied in size, wherein the control means includes a switching means to switch the electron focussing means between a first unfocused state in which the x-ray source has a first area upon action of the shutter and a second focused state in which the x-ray source has a second area smaller than said first area when the shutter is open.

2. The x-ray generator according to claim 1, wherein said first area has a surface area at least twice that of said second area.

3. The x-ray generator according to claim 1, wherein said first area has a surface area at least four times that of said second area.

4. The x-ray generator according to claim 1, wherein said first area has a surface area at least ten times that of said second area.

5. The x-ray generator according to claim 1, wherein the target is a metal selected from the group Cu, Ag, Mo, Rh, Al, Ti, Cr, Co, Fe, W, Au.

6. The x-ray generator according to claim 1, wherein the electron gun comprises an evacuated tube, and wherein the electron focussing means comprises an x-y deflection system for centering the electron beam in the tube.

7. The x-ray generator according to claim 6, wherein the electron beam focussing means further comprises at least one electron lens.

8. The x-ray generator according to claim 7, wherein said electron lens comprises an axially symmetric or round lens for focussing the electron beam to a line focus and for steering the electron beam.

9. The x-ray generator according to claim 7, wherein said electron lens comprises at least one quadripole or multipole lens for focussing the electron beam to a line focus and for steering the electron beam.

10. A method for extending the life of a target of an x-ray generator, wherein the generator comprises an electron gun, electron focussing means and a target, the method comprising the steps of:

firing electrons at the target such that the area of the target on which the focussing means causes electrons from said electron gun to impinge comprises an x-ray source; and controlling the electron focussing means by action of a shutter to move between a plurality of focussed states, whereby in each state the x-ray source is in a corresponding discrete stationary position on said target, such that the intensity per unit area in each discrete position is substantially constant, and such that there is no overlap on the target between the discrete positions corresponding to each focussed state.

11. A method for extending the life of a target of an X-ray generator, wherein the generator comprises an electron gun, electron focussing means and a target, the method comprising the steps of:

firing electrons at the target such that the area of the target on which the focussing means causes electrons from said electron gun to impinge comprises an x-ray source emitting an x-ray beam;

controlling the emitted x-ray beam by action of a shutter in its path; and controlling the electron focusing means by action of the shutter to move between a first unfocused state in which the x-ray source has a first area and a second focused state in which the x-ray has a second area smaller than the first area, the intensity of electron impingement in the first state being sufficiently low to reduce target degradation, the intensity of electron impingement in the second state being sufficiently high such that the source produces a predetermined required level of brightness and source size on the target.

12. The method according to claim 11, wherein the electron beam current is substantially the same in the first and second states, while the intensity of the beam per unit area at the target is lower in the first state than in the second state.

* * * * *